US007486263B2

(12) United States Patent
Anderson et al.

(10) Patent No.: US 7,486,263 B2
(45) Date of Patent: Feb. 3, 2009

(54) ELECTROSTATIC DEVICE

(75) Inventors: Daryl E. Anderson, Corvallis, OR (US); Eric T. Martin, Corvallis, OR (US); Andrew L. Van Brocklin, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 776 days.

(21) Appl. No.: 10/794,636

(22) Filed: Mar. 5, 2004

(65) Prior Publication Data

US 2005/0195138 A1 Sep. 8, 2005

(51) Int. Cl.
*G09G 3/34* (2006.01)

(52) U.S. Cl. ..... 345/85; 345/86; 345/93; 345/108

(58) Field of Classification Search ..... 345/20–35, 345/85–98, 204–215, 690–699; 310/309; 359/223–225, 291
See application file for complete search history.

(56) References Cited

U.S. PATENT DOCUMENTS

| | | | | |
|---|---|---|---|---|
| 6,577,376 | B1 * | 6/2003 | Shih | 349/202 |
| 6,998,758 | B2 * | 2/2006 | Aksyuk et al. | 310/309 |
| 2004/0227493 | A1 * | 11/2004 | Van Brocklin et al. | 320/166 |
| 2004/0245888 | A1 * | 12/2004 | Aksyuk et al. | 310/309 |
| 2006/0077517 | A1 * | 4/2006 | Yun | 359/290 |

* cited by examiner

*Primary Examiner*—Vijay Shankar

(57) ABSTRACT

An electronic device includes a first member, and a second member which includes segments. At least one of the first member and the second member is movable relative to the other of the first member and the second member among a plurality of distinct positions as a result of differing voltage states of the segments.

8 Claims, 8 Drawing Sheets

ELECTROSTATIC DEVICE

BACKGROUND

Diffractive light devices (DLDs) are microelectromechanical (MEMS) devices which may currently be used, for example, for spatial light modulation in high resolution displays for devices such as front or rear projection devices, laptop and notebook computers, personal digital assistant (PDA) devices, wireless phones, etc., or for wavelength management in optical communication systems. A DLD typically requires a dedicated voltage supply for each desired color. These voltage supples consume significant space and add cost to the DLD. Further, if each voltage is generated within the DLD device itself, it may be subject to undesirable noise and other variations due to processing of the supply voltage and temperature shifts. If each supply voltage is generated externally, the DLD device must provide pins such that external voltage sources may be connected. Additionally, color perception problems may result if one of the voltages shifts with respect to the others.

DETAILED DESCRIPTION

Figure 1:
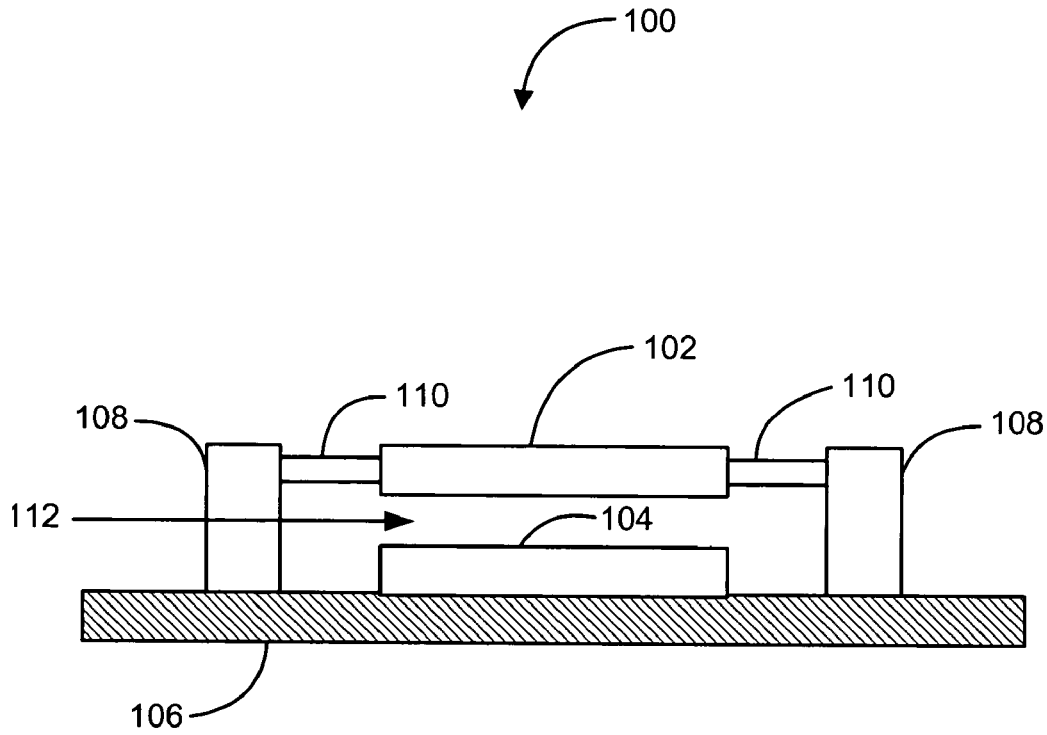
FIG. 1 is a side elevational view schematically illustrating an electrostatic device according to an exemplary embodiment.

FIG. 1 illustrates an electrostatic device 100 according to an exemplary embodiment. In one embodiment, device 100 may be a DLD used to at least partially display a pixel of a displayable image. In another embodiment, device 100 may be used for wavelength management in an optical communication system. In another embodiment, device 100 may be employed as an actuator or other application where one member is to be moved relative to another member.

Device 100 includes a base 106, posts 108, flexures 110, and a cavity 112 which has a variable width defined by a member 102 and a member 104. Member 102, or alternatively member 104, includes two or more individual segments. In one embodiment, member 104 further comprises two or more segments, while member 102 is non-segmented. In another embodiment, member 102 comprises two or more segments and member 104 is non-segmented. The width of cavity 112 may be discretely varied by, for example, by applying a first voltage to the non-segmented member (e.g., member 102) and a second voltage to one or more of the segments in the segmented member (e.g., member 104) to create an electrostatic force between members 102 and 104. Each segment has an associated surface area (shown, e.g., in FIG. 2A) such that a voltage may be separately applied to each individual segment to create differing electrostatic forces that are a function of the surface area of the segment.

Base 106 serves as a structural foundation for device 100. Base 106 may be a substrate material such as silicon or another material. Base 106 may also include control circuitry for device 100. Posts 108 and member 104 are coupled to base 106. Posts 108 support flexures 110 and member 102, and may also be used to route electrical outputs from control circuitry base in 106 to member 102.

Flexures 110 allow the width of cavity 112 to vary by allowing member 102 to move with respect to member 104 when an electrostatic force exists between member 102 and member 104. Flexures 110 are coupled to posts 108 and to member 102. For purposes of this disclosure, the term "coupled" shall mean the joining of two structures directly or indirectly to one another. Such joining may be stationary in nature or movable in nature. Such joining may be achieved with the two structures or the two structures and any additional intermediate structures being integrally formed as a single unitary body with one another or with the two structures or the two structures and any additional intermediate structure being attached to one another. Such joining may be permanent in nature or alternatively may be removable or releasable in nature.

Flexures 110 are formed from one or more flexible materials such as a metal or polymer and have a spring functionality that may be linear or non-linear. In one exemplary embodiment, flexures 110 are formed from tantalum aluminum. The spring functionality of flexures 110 provides a spring force which serves to balance the electrostatic force created between members 102 and 104. In other embodiments, mechanisms other than flexures 110 may be used to movably support member 102 relative to member 104. For example, member 102 may alternatively be configured to pivot or slide between different positions relative to member 104. Flexures 110 have a spring restoring force such that the electrostatic force between members 102 and 104 causes flexures 110 to yield and allow member 102 to move to a discrete position depending on the number of electrically charged segments in member 104, or in another embodiment, the number of electrically charged segments in member 102. In embodiments where device 100 is a DLD, flexures 110 form a spring mechanism that allows the width of cavity 112 to be varied to select a particular wavelength of light at a particular intensity.

Cavity 112 has a width which may be electronically varied. In embodiments where device 100 is a DLD, cavity 112 may be an optical cavity that is variably selective of a particular wavelength of light at a particular intensity by producing a desired optical interference of light passing therein, and may either reflect or transmit the particular wavelength at the particular intensity. That is, cavity 112 may be reflective or transmissive of a particular wavelength of light at a particular intensity. The particular wavelength and intensity selected by cavity 112 is a function of the width of cavity 112. That is, in embodiments where device 100 is a DLD, cavity 112 may be tuned to a particular wavelength of light at a particular intensity by electronically controlling the width. In embodiments where device 100 is associated with a pixel of a display configured to display a pixilated displayable image, widths of cavity 112 may range on the order of approximately 800 Å to 5000 Å. Of course, other ranges of widths may be optimal depending upon the particular application in which device 100 is used.

Members 102 and 104 define the width of cavity 112. In one embodiment, member 102 is moveable with respect to member 104 via flexures 110, and member 104 is segmented and fixed to base 106. In another embodiment, member 102 is segmented rather than member 104, and is moveable with respect to member 104. Members 102 and 104 may vary in size, shape, and construction. For example, in embodiments where device 100 is a DLD, member 102 may be a semi-reflective (i.e., semi-transparent) plate such as a silicon oxide plate, while member 104 may be a highly reflective plate such as an aluminum plate. In embodiments where device 100 is associated with a pixel of a display configured to display a pixilated displayable image, members 102 and 104 may be substantially square in shape with a width of approximately ⅓ micron and measure approximately 15 microns to 20 microns on each side. In another embodiment, members 102 and 104 may be circular in shape. The shape and dimensions of members 102 and 104 may, of course, vary.

An electrostatic force is created between member 102 and member 104 to discretely vary the width of cavity 112 by establishing a voltage difference between the non-segmented member (e.g., member 102) and a number of the segments in the segmented member (e.g., member 104). In one embodiment, the voltage difference is established by applying a first voltage to the non-segmented member (e.g., member 102) and a second voltage to a number of the segments in the segmented member (e.g., member 104). In this embodiment, the first voltage is a bias voltage provided by a supply voltage source (e.g., supply voltage source 302 shown in FIG. 4) coupled to the non-segmented member, and the second voltage is a reference voltage provided by a reference voltage source (e.g., reference voltage source 304 shown in FIG. 4) which is configured to be selectively applied to each segment in the segmented member. Thus, in this embodiment the same voltage difference is established between the non-segmented member and each of the segments coupled to the reference voltage source. In one embodiment, the supply voltage is DC voltage of approximately 0 and the reference voltage is a DC voltage of approximately 12 V so that a voltage difference of approximately 12 VDC is maintained between the non-segmented member and each segment to which the reference voltage is applied. In other embodiments, other voltages are used to maintain other desired voltage differences. In another embodiment, the reference voltage is selectively applied to a number of segments to maintain a predetermined amount of charge on each segment. In another embodiment, more than one reference voltage source is used. In this embodiment, different reference voltages may be used to establish differing voltage differences between the non-segmented member and each of the segments coupled to one of the reference voltage sources.

In one embodiment, a single reference voltage source is used with device 100 to generate several widths of cavity 112 because the use of a segmented member eliminates the need for a separate reference voltage source to provide a different voltage for each width of cavity 112. Instead of applying different voltages across member 102 and member 104 to achieve different amounts of electrostatic force between members 102 and 104, a single reference voltage may be applied to one or more segments to achieve the different amounts of electrostatic force between members 102 and 104. The discrete number of widths to which cavity 112 may be electronically adjusted using a single reference voltage source depends on the size and number of segments in the segmented member. The use of a single reference voltage source reduces cost and space requirements for control circuitry required for control of device 100. Additionally, the relationship between each width of cavity 112 may be determined in part by the accuracy of the process by which each segment is formed rather than solely by the precise control of various reference voltages. This reduces the effects of noise, temperature, and voltage shifting which may create color perception and other problems in, for example, displays for laptops or notebook computers which utilize one or more of device 100. In another embodiment, multiple reference voltage sources may be used with device 100 to achieve an even greater number of widths of cavity 112. In this embodiment, the discrete number of widths to which cavity 112 may be electronically adjusted depends on the size and number of segments in the segmented member, as well as the number of reference voltage sources that are coupled to each segment.

Figure 2A:
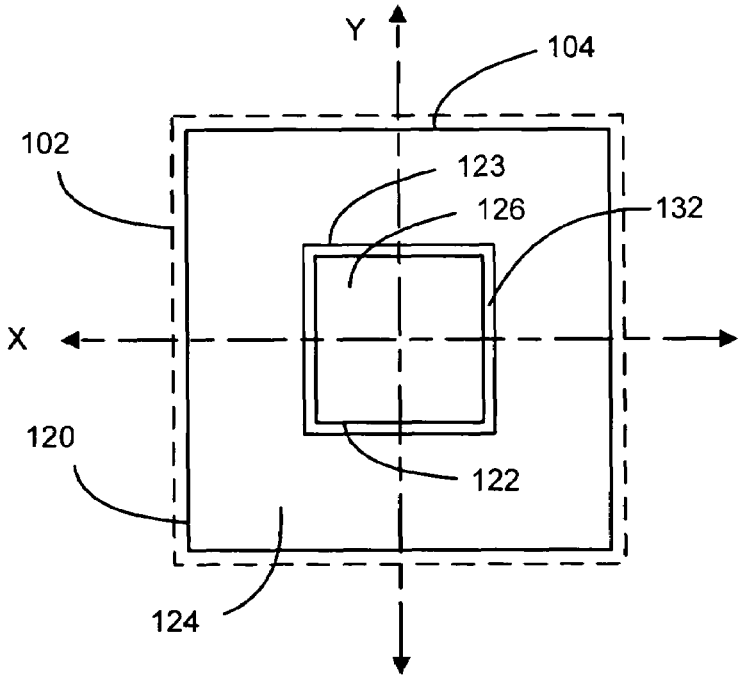
FIG. 2A is a top plan view schematically illustrating a first embodiment of a segmented member of the device of FIG. 1 according to an exemplary embodiment.

FIG. 2A illustrates one particular embodiment in which member 104 includes segments 120 and 122 and a separator 123. In other embodiments, member 102 may alternatively include segments 120 and 122 and separator 123. Segments 120 and 122 may be variably charged to create discrete amounts of electrostatic force between member 102 (shown in phantom for reference in FIG. 2A) and member 104 such that member 102 may be discretely displaced with respect to member 104. Segments 120 and 122 are a conductive material, such as aluminum. In other embodiments, segments 120 and 122 may be formed from other materials. For example, in embodiments where member 104 is segmented according to FIG. 2A, segments 120 and 122 may be made of aluminum such that member 104 has a reflective surface. In another embodiment, member 102, rather than member 104, is segmented according to FIG. 2A, and segments 120 and 122 may be made of another material such that member 102 is semi-reflective.

In the illustrated embodiment, segments 120 and 122 are shown to be essentially square in shape, with segment 122 centered inside segment 120 such that substantial symmetry is maintained for each segment with respect to the center of a plane defined by movable member 102 in both the X and Y directions. In the illustrated embodiment, substantial symmetry is maintained in order to balance the electrostatic forces from each electrically charged segment 120 and 122 such that member 102 will be substantially parallel in orientation with respect to member 104 when, for example, a voltage is applied to segments 120 and 122 to move member 102 with respect to member 104. In embodiments where device 100 (shown in FIG. 1) is a DLD associated with a pixel of a display configured to display a pixilated displayable image, tilting of member 102 may cause undesirable color distortion. Thus, in embodiments of device 100 where a uniform width of cavity 112 is desired, any configuration of segments 120 and 122 may be used which provides symmetry about the center of a plane defined by member 102. For example, in another embodiment, segments 120 and 122 may be essentially circular in shape. In another embodiment, segments 120 and 122 may be essentially rectangular in shape. In other embodiments, such as those where tilting of member 102 is desirable, segments 120 and 122 may be configured without regard to symmetry about the center of the plane defined by member 102 in order to permit member 102 to assume a tilted orientation with respect to member 104.

Segment 120 has a first surface area 124 and segment 122 has a second surface area 126. In the illustrated embodiment, surface area 124 is greater than surface area 126. Segments 120 and 122 are formed with surface areas 124 and 126 and separator 123 such that a reference voltage may be separately applied to segment 120 and/or segment 122 to create an electrostatic force that is a function of the size of the surface area of each segment to which the reference voltage is applied For example, in embodiments where surface area 124 is greater than surface area 126, a reference voltage may be separately applied to segment 120 to create an electrostatic force that is larger than the electrostatic force created by applying the same reference voltage only to segment 122.

Separator 123 comprises a structure or opening configured to electrically separate segments 120 and 122. For purposes of this disclosure, the phrase "electrically separate" means to separate the electrical energy associated with each individual segment, disregarding the effects of fringing electrical fields. In one embodiment, separator 123 comprises a gap 132, such as an air gap, between segments 120 and 122 to electrically separate segment 120 from segment 122. In another embodiment, separator 123 comprises a coating 134 (shown in FIG. 2C), such as an oxide or another material, applied to segments 120 and 122 so that coating 134 occupies gap 132 between segments 120 and 122. In embodiments where device 100 is a DLD, coating 134 is a transparent material, such as a transparent oxide. In other embodiments, coating 134 is a non-transparent material.

In embodiments of device 100 (shown in FIG. 1) where a single reference voltage source is used, the number of segments in a member determines the number of discrete widths of cavity 112 for device 100. For example, in embodiments of device 100 using the segmented member illustrated in FIG. 2A having segments 120 and 122, there are potentially four discrete widths which cavity 112 may assume, given a single reference voltage source for segments 120 and 122 and differing surfaces areas 124 and 126.

Figure 2C:
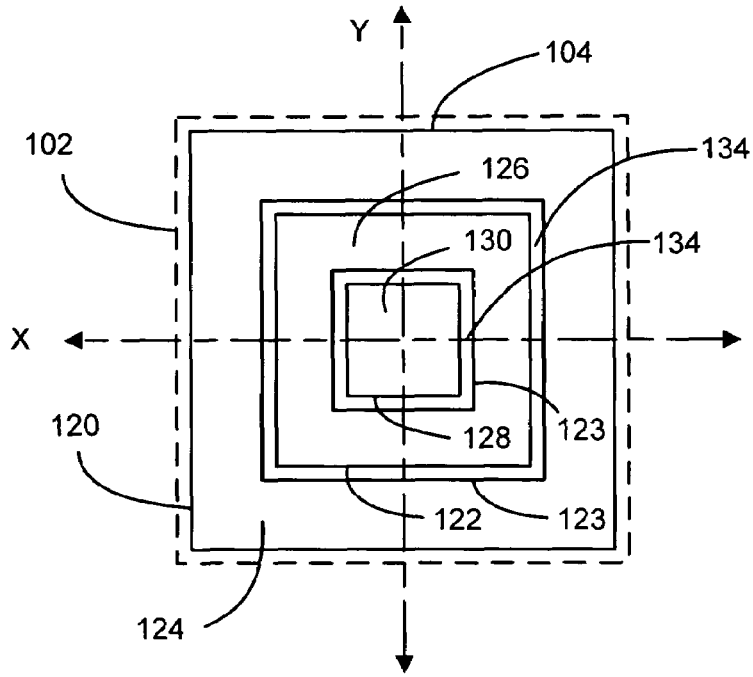
FIG. 2C is a top plan view of a second embodiment of a segmented member of the device of FIG. 1 according to an exemplary embodiment.
Figure 2B:
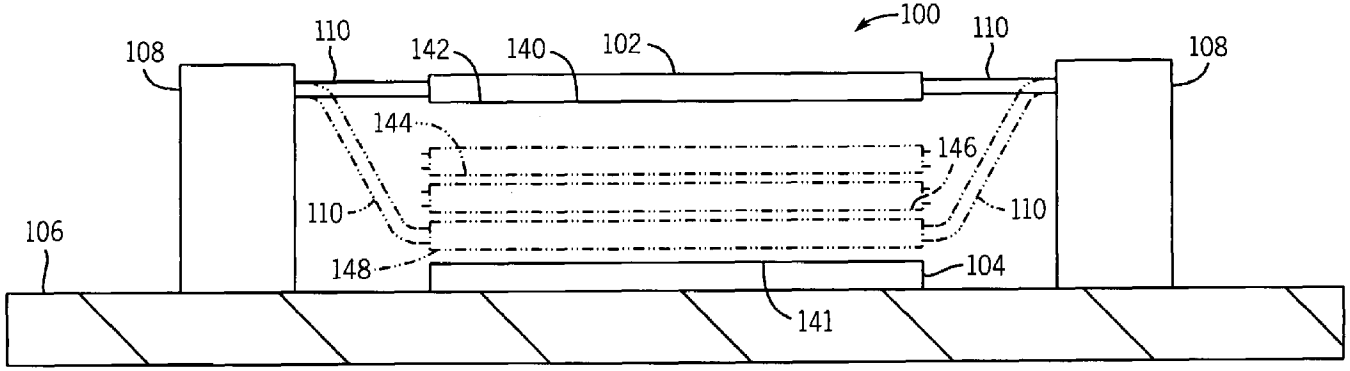
FIG. 2B is a side elevational view schematically illustrating the device of FIG. 2A having a cavity adjustable to four discrete widths according to an exemplary embodiment.

FIG. 2B illustrates each of the four discrete widths according to the embodiment of member 104 illustrated in FIG. 2A where a single reference voltage source is used. Each of the four discrete widths is defined between lower surface 140 of member 102 and upper surface 141 of member 104 where lower surface 140 of member 102 is in positions 142, 144, 146, and 148 respectively. A first discrete width corresponds to where no voltage is applied to segments 120 and 122 and lower surface 140 is in position 142. A second discrete width corresponds to where the reference voltage is applied to segment 122 only and where lower surface 140 is in position 144. A third discrete width corresponds to where the reference voltage is applied to segment 120 only and where lower surface 140 is in position 146. A fourth discrete width corresponds to where the reference voltage is applied to both segment 120 and segment 122 and where lower surface 140 is in position 148. In embodiments where device 100 (shown in FIG. 1) is a DLD, each discrete width may correspond to a particular wavelength of light to be reflected or transmitted, such that cavity 112 may be tuned to reflect or transmit up to four particular wavelengths of light. In embodiments where device 100 is a DLD associated with a pixel of a display configured to display a pixilated displayable image, each discrete width of cavity 112 may correspond to a particular color of light such that cavity 112 may be adjusted to produce up to four different colors of light.

While two segments are shown in the embodiment illustrated in FIGS. 2A and 2B, any suitable number of segments may be used to obtain the desired number of discrete widths. For example, FIG. 2C illustrates an embodiment in which member 104 includes segments 120, 122, and 128, and separators 123. In other embodiments, member 102 may alternatively include segments 120, 122, and 128, and separators 123. In the illustrated embodiment, segment 128 has an associated surface area 130 which is smaller than surface area 126 associated with segment 122. In turn, surface area 126 is smaller than surface area 124 associated with segment 120. In this embodiment, there are potentially eight discrete widths which cavity 112 may assume, given a single reference voltage source for segments 120, 122, and 128 and differing surfaces areas 124, 126, and 130.

Figure 2D:
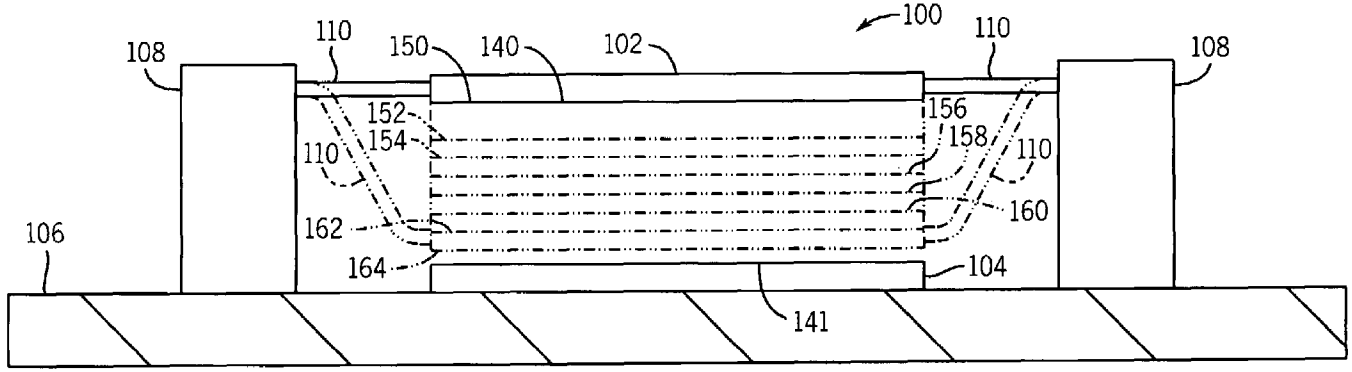
FIG. 2D is a side elevational view schematically illustrating the device of FIG. 2C having a cavity adjustable to eight discrete widths according to an exemplary embodiment.

FIG. 2D illustrates each of the eight discrete widths according to the embodiment of member 104 illustrated in FIG. 2C where a single reference voltage source is used. Each of the eight discrete widths is defined between lower surface 140 of member 102 and upper surface 141 of member 104 where lower surface 140 of member 102 is in positions 150, 152, 154, 156, 158, 160, 162, and 164 respectively. A first discrete width corresponds to where no voltage is applied to segments 120, 122, and 128 and lower surface 140 is in position 150. Second, third, and fourth discrete widths correspond respectively to where the reference voltage is applied to segment 128 only, segment 122 only, and segment 120 only, and where lower surface 140 is in positions 152, 154, and 156 respectively. A fifth discrete width corresponds to where the reference voltage is applied to both segment 128 and segment 122 and where lower surface 140 is in position 158. A sixth discrete width corresponds to where the reference voltage is applied to both segment 128 and segment 120 and where lower surface 140 is in position 160. A seventh discrete width corresponds to where the reference voltage is applied to both segment 120 and segment 122 and where lower surface 140 is in position 162. An eighth discrete width corresponds to where the reference voltage is applied to each of the segments 120, 122, and 128 and where lower surface 140 is in position 164.

Figure 3:
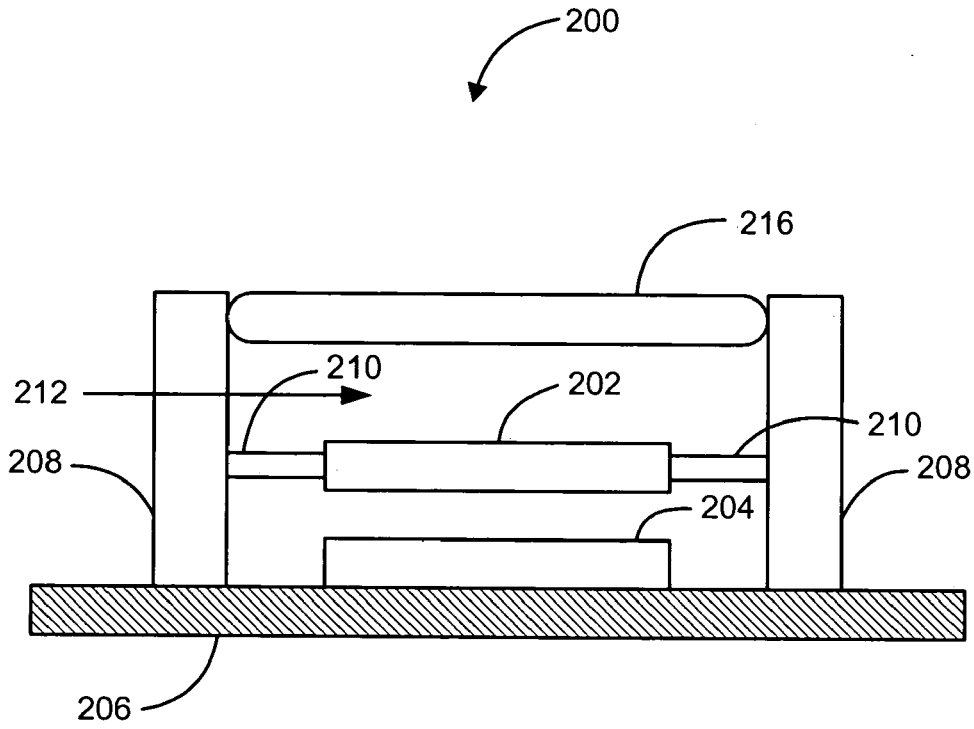
FIG. 3 is a side elevational view schematically illustrating another embodiment of the device of FIG. 1 according to an exemplary embodiment.

FIG. 3 illustrates an electrostatic device 200 according to another embodiment. Device 200 includes a base 206, posts 208, flexures 210, and members 202, 204, and 216. A cavity 212 is defined by members 202 and 216 which has a variable width. Base 206, posts 208 and flexures 210 are similar to base 106, posts 108 and flexures 110 of device 100 (shown in FIG. 1). Member 216 is fixed to posts 208 and member 204 is fixed to base 206, while flexures 210 allow member 206 to move with respect to member 204 and member 216 when an electrostatic force exists between member 202 member 204, or between member 202 and member 216. In embodiments where device 200 is a DLD, member 216 may be a semi-reflective (i.e., semi-transparent) plate while member 202 may be a highly reflective plate. In one embodiment, member 202 further comprises a number of segments, while members 204 and 216 are non-segmented. In this embodiment, the width of cavity 212 may be discretely varied by, for example, applying a first voltage to member 216 or a second voltage to member 204, and a third voltage to one or more of the segments in member 202 to create an electrostatic force between member 202 and member 216, or between member 202 and member 204. Where an electrostatic force of attraction exists between member 216 and member 202, the width of cavity 212 is discretely increased depending on the number of charged segments in member 202. Where an electrostatic force of attraction exists between member 204 and member 202, width of cavity 212 is discretely decreased depending on the number of charged segments in member 202. In another embodiment, members 204 and 216 further comprise a number of segments and member 202 is non-segmented. In this embodiment, width of cavity 212 may be discretely varied by, for example, applying a first voltage to member 216 and a second voltage to one or more of the segments in either member 204 or member 216 to create an electrostatic force between member 202 and member 204 or between member 202 and member 216.

Figure 4:
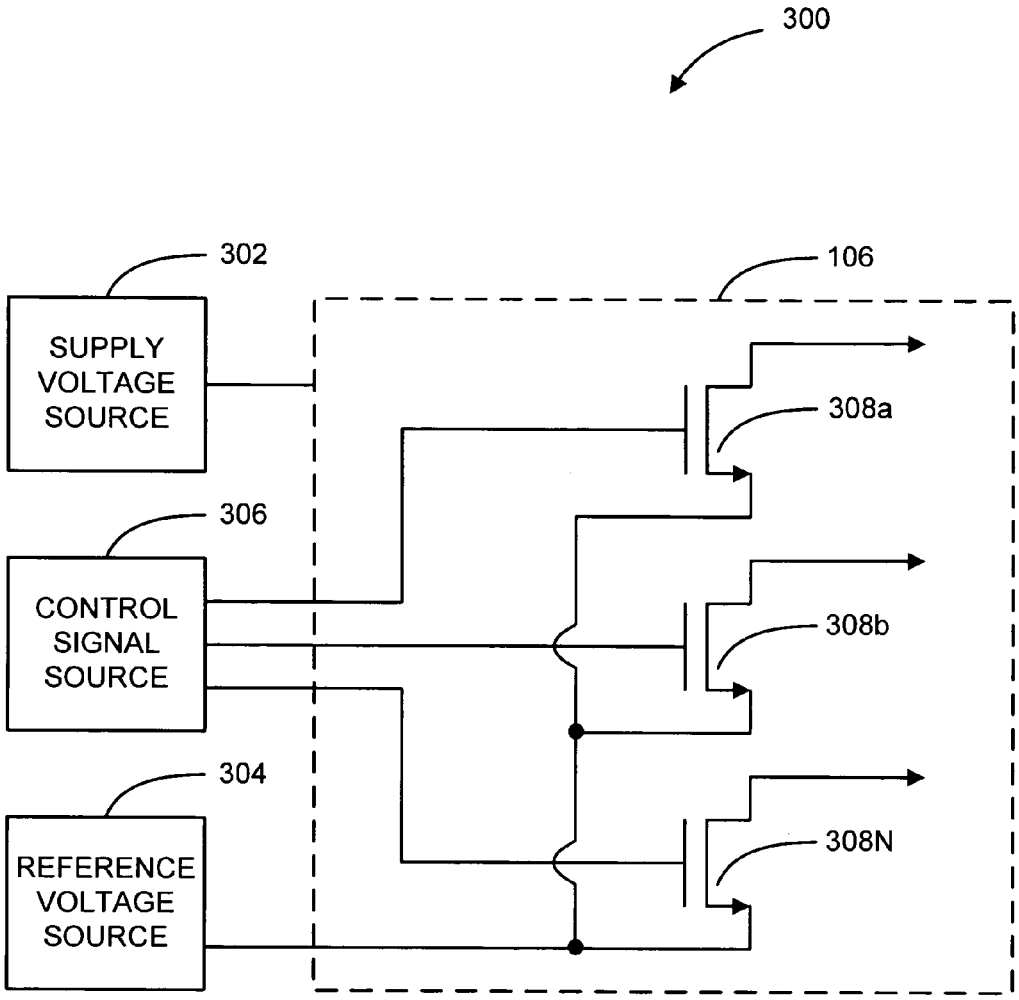
FIG. 4 is a diagram schematically illustrating a control circuit according to an exemplary embodiment.

FIG. 4 illustrates a diagram of an electronic control circuit 300 according to one exemplary embodiment. Control circuit 300 may be used to electronically control, for example, various embodiments of device 100 (shown in FIG. 1) or device 200 (shown in FIG. 3). Control circuit 300 includes supply voltage source 302, reference voltage source 304, control signal source 306, and two or more transistors 308 (shown in FIG. 4 as 308*a*, 308*b*, and 308N). Supply voltage source 302 is located external to device 100 (shown in FIG. 1) or device 200 (shown in FIG. 3) and is coupled to each non-segmented member. Supply voltage source 302 provides a bias voltage to each non-segmented member. For example, in one embodiment, supply voltage source 302 provides a single DC bias voltage to the non-segmented member (e.g., member 102 of device 100 or member 202 of device 200). In another embodiment, supply voltage source 302 provides a first DC bias voltage to member 216 and a second DC bias voltage to member 204 of device 200 where members 204 and 216 are non-segmented.

Transistors 308 comprise devices configured to apply reference voltage source 304 to an electrically isolated segment in response to a control signal from control signal source 306. Each segment N in the segmented member of device 100 or the segmented member(s) of device 200 is coupled to a corresponding transistor 308. For example, when used with device 100 (shown in FIG. 1), where device 100 includes segments 120 and 122 (shown in FIG. 2A) in member 104, control circuit 300 includes transistors 308*a* and 308*b* which correspond to and are coupled to segments 120 and 122 respectively. When alternatively used with device 200 (shown in FIG. 3), where device 200 includes segments 120, 122, and 128 (shown in FIG. 2C) in member 202, control circuit 300 includes transistors 308*a* through 308N which correspond to and are coupled to segments 120, 122, and 128 respectively. In another embodiment, each segment N in the segmented member of device 100 has more than one corresponding transistor 308 such that differing voltages may be applied to each segment. For example, in one embodiment, each segment N in the segmented member of device 100 has two corresponding transistors 308 such that one transistor applies a reference voltage and the other transistor applies a "reset" voltage different from the reference voltage to restore the segment to a default voltage state.

Transistors 308 are located within, for example, base 106 (shown in phantom for reference in FIG. 4) of device 100 or base 206 of device 200 and may be formed by a suitable photolithographic process. Transistors 308 may be MOS devices such as PMOS or NMOS devices, or any other suitable transistor. In embodiments where transistors 308 are PMOS or NMOS devices, the drain of each transistor 308 is coupled to the corresponding electrically isolated segment, the source of each transistor 308 is coupled to reference voltage source 304, and the gate of each transistor 308 is coupled to a control signal from control signal source 306.

Reference voltage source 304 is located external to device 100 (shown in FIG. 1) or device 200 (shown in FIG. 3) and is coupled to each segment of each segmented member via the transistor 308 corresponding to each segment. In one embodiment, the same fixed reference voltage is provided to each segment such that the desired voltage difference V is maintained between each segment and the non-segmented member. In another embodiment, the same reference voltage is provided to each segment such that the desired amount of charge is placed on each segment.

Control signal source 306 is located external to device 100 (shown in FIG. 1) or device 200 (shown in FIG. 3) and is coupled to each transistor 308. Control signal source 306 provides a separate control signal (e.g., a voltage control signal or charge control signal) to each transistor 308 such that transistor 308 may couple or de-couple reference voltage source 304 to the corresponding segment in response to the control signal. For example, in one exemplary embodiment, control signal source 306 is used to discretely adjust width of cavity 112 of device 100 (shown in FIG. 1) by generating control signals to transistors 308 which variously couple or uncouple reference voltage source 304 to each of the segments in the segmented member (e.g., member 104 of device 100).

Figure 5:
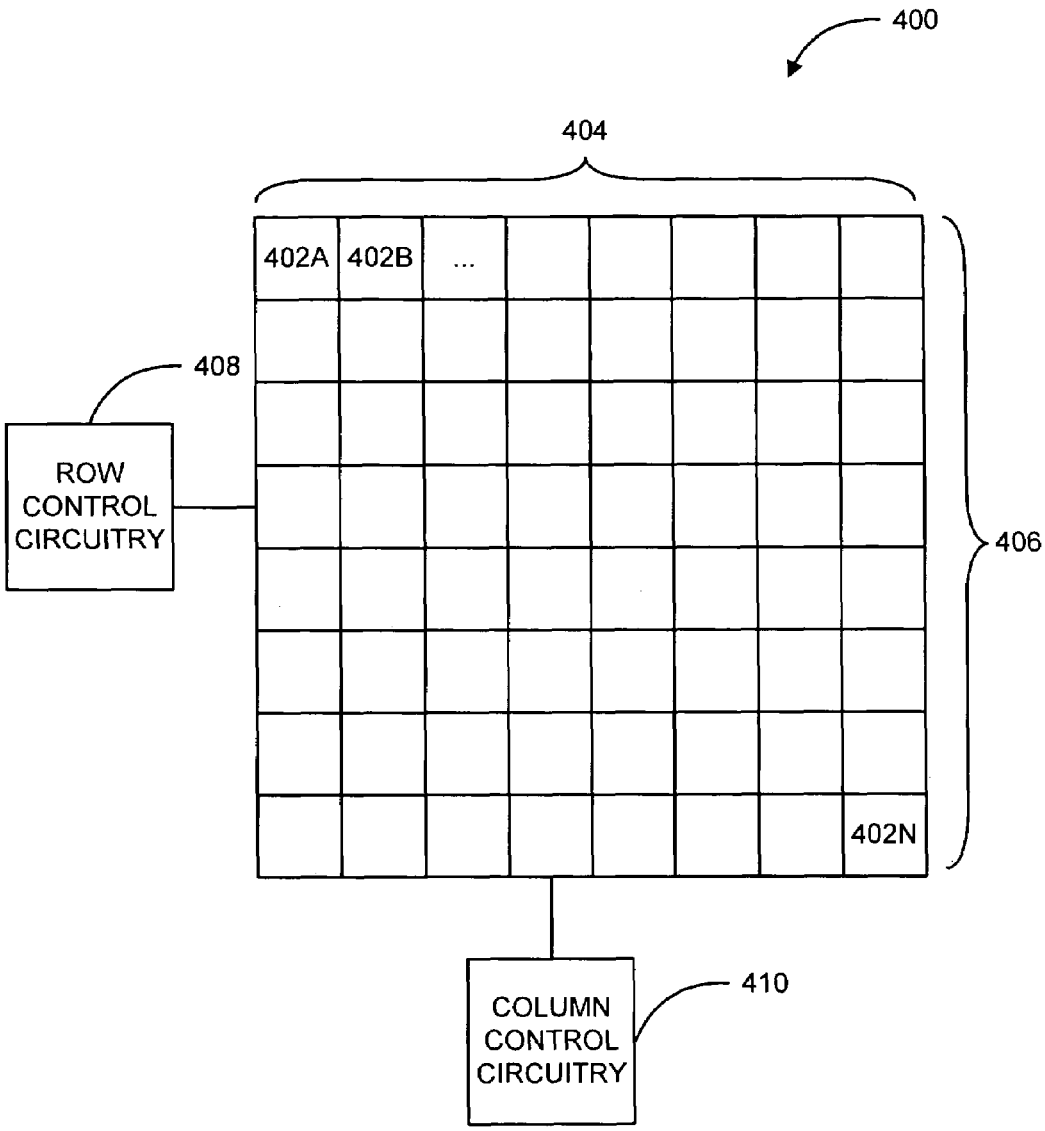
FIG. 5 is a diagram schematically illustrating an array of pixel mechanisms according to an exemplary embodiment.

FIG. 5 illustrates an array 400 of pixel mechanisms 402 according to one exemplary embodiment. Array 400 may be used, for example, as part of a display device for displaying a pixilated image. Pixel mechanisms 402 include mechanisms 402A, 402B, . . . , 402N, organized into columns 404 and rows 406. Array 400 is coupled to row control circuitry 408 and column control circuitry 410. Each pixel mechanism 402 is configured to variably select one of several discrete wavelengths of light at a particular intensity by optical interference in correspondence with a displayable pixilated image. In one embodiment, each pixel mechanism 402 includes one or more of device 100 (shown in FIG. 1). In another embodiment, each pixel includes one or more of device 200 (shown in FIG. 3).

Figure 6:
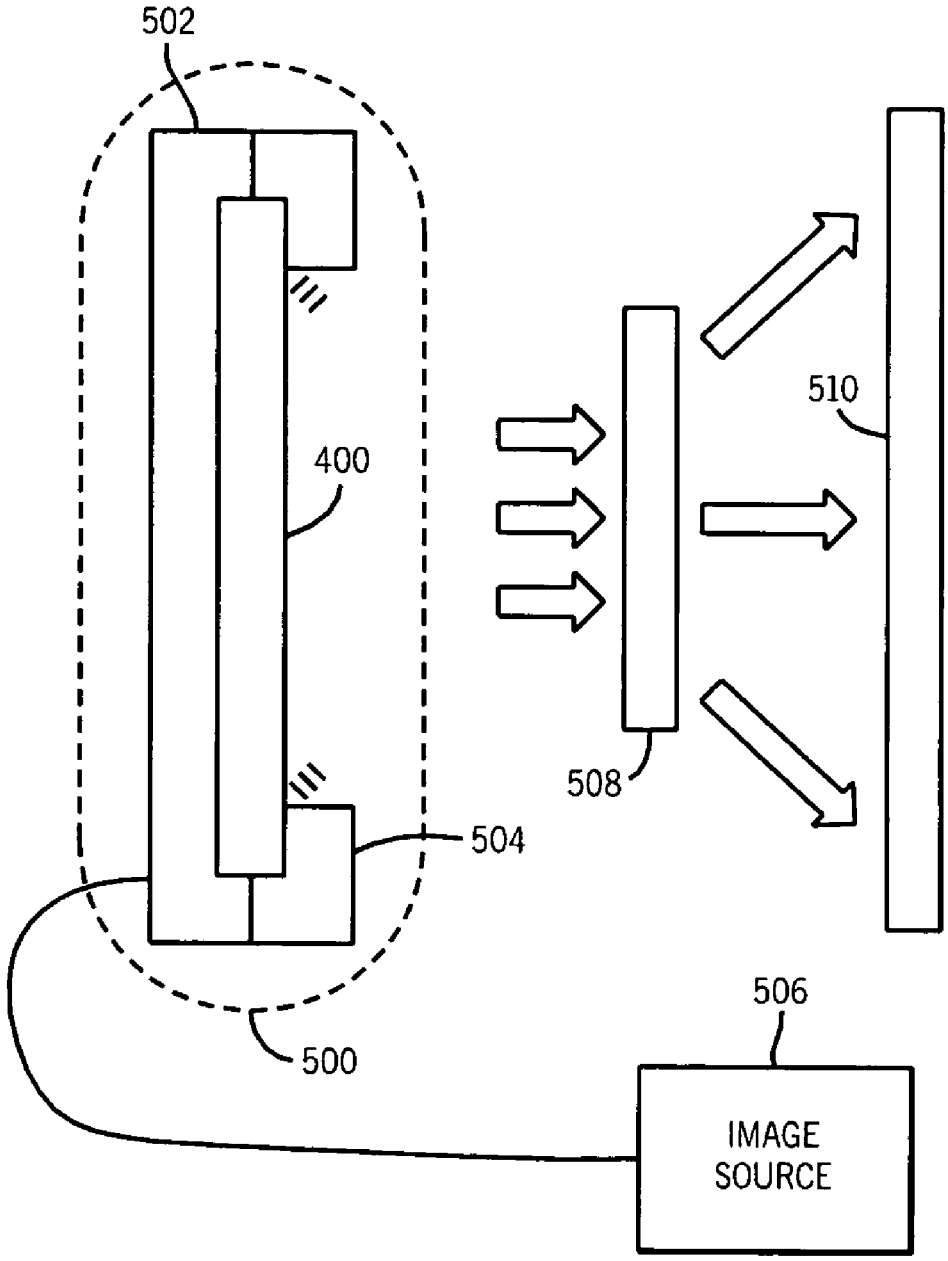
FIG. 6 is a diagram schematically illustrating a display device according to an exemplary embodiment.

FIG. 6 illustrates a cross-sectional profile of a display device 500 according to one exemplary embodiment. Display device 500 may be incorporated as part of a front or rear projection device, flat screen monitor, laptop or notebook computer, personal digital assistant (PDA) device, wireless phone, or other device. Display device 500 includes a controller 502, optional supplemental light source 504, an image source 506, and an array 400 of pixel mechanisms 402. Optional supplemental light source 504 outputs light for reflection by array 400 of pixel mechanisms 402. Where optional supplemental light source 504 is present, array 400 of pixel mechanisms 402 reflects both the light provided by source 504, as well as any ambient light. Where optional light source 504 is absent, array 400 of pixel mechanisms 402 reflects ambient light. Optional light source 504 is indicated in the embodiment of FIG. 6 such that it outputs light for reflection by array 400 of pixel mechanisms 402. In another embodiment, optional light source 504 may be behind array 400 of pixel mechanisms 402 such that array 400 of pixel mechanisms 402 transmits light output from optional light source 504. In another embodiment, display device 500 is incorporated as part of a projection device, and further includes optics 508. Light reflected by array 400 of pixel mechanisms 402 passes through optics 508 and is projected onto screen 510.

Controller 502 includes row control circuitry 408 and column control circuitry 410 and controls array 400 of pixel mechanisms 402, effectively providing a pixilated displayable image to array 400 of pixel mechanisms 402. That is, in embodiments where pixel mechanisms 402 include, for example, one or more of device 100 (shown in FIG. 1), controller 502 discretely varies width of cavity 112 so that the pixilated image is properly rendered by pixel mechanisms 402 for display. Controller 502 receives the displayable image from an image source 506 in a pixilated or non-pixilated manner. If non-pixilated, or if pixilated in a manner that does not correspond to a one-to-one basis to array 400 of pixel mechanisms 402, controller 502 divides the image into pixels corresponding to array 400 of pixel mechanisms 402. Image source 506 may be external to display device 500 as shown in FIG. 6, or may internal to display device 500. Accordingly, image source 506 may be, for example, a desktop computer external to display device 500, or may be a projection device, laptop or notebook computer, personal digital assistant (PDA) device, wireless phone, or other device of which display device 500 is part.

Figure 7:
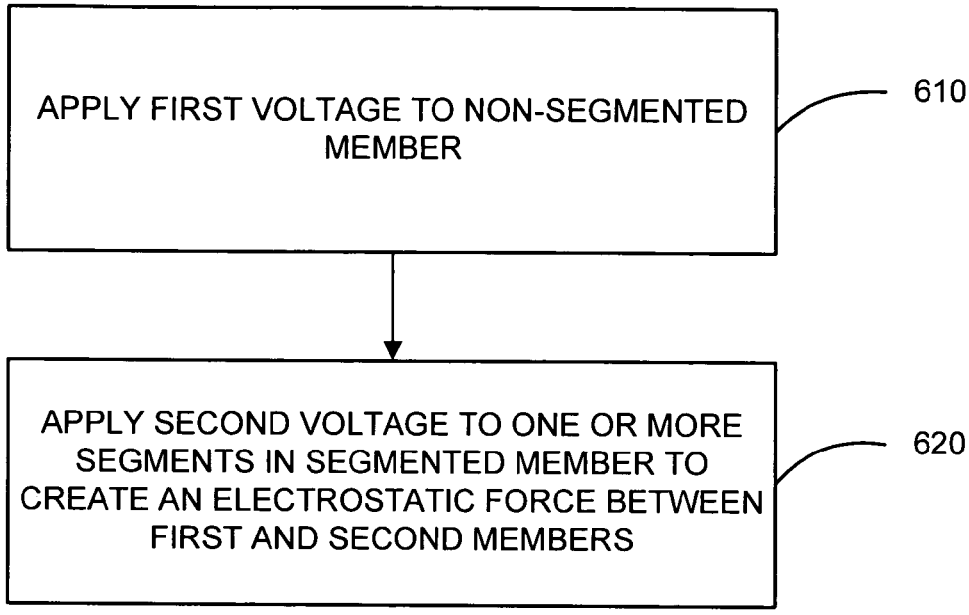
FIG. 7 is a flowchart illustrating a method of use of the device of FIG. 1 according to an exemplary embodiment.

FIG. 7 illustrates a method for discretely varying the width of cavity 112 of device 100 (shown in FIG. 1) according to one exemplary embodiment. At step 610, a first voltage is applied to the non-segmented member of device 100 as has been described above. For example, in one embodiment, the first voltage is applied to member 102, where member 102 is the non-segmented member. In another embodiment, the first voltage is applied to member 104, where member 104 is the non-segmented member. At step 620, a second voltage is applied to one or more electrically isolated segments in the segmented member of device 100 to create an electrostatic force between members 102 and 104, as has been described above. For example, in one embodiment, device 100 includes a member 104 with two electrically isolated segments according to FIG. 2A, and the second voltage is applied to one or both segments. In another embodiment, device 100 includes a member 104 with three electrically isolated segments according to FIG. 2C, and the second voltage is applied to one, two, or all three of the segments. Step 620 may repeated as required to achieve the desired width of cavity 112.

It should be understood that these embodiments are offered by way of example only. Many modifications are possible without materially departing from the novel teachings and advantages of the subject matter recited in the claims. For example, additional or fewer members may be included in a device, as well as varying numbers, sizes, and shapes of segments. Unless specifically otherwise noted, the claims reciting a single particular element also encompass a plurality of such particular elements. Accordingly, all such modifications are intended to be included within the scope of the devices and methods described herein. The order and sequence of any process or method steps may be varied or re-sequenced according to other embodiments. Other substitutions , modifications, changes, and omissions may be made without departing from the spirit and scope of the devices and methods described herein.

What is claimed is:

1. A device comprising:

a first member; and a second member including segments;

wherein at least one of the first member and the second member is movable among distinct positions as a result of differing voltage states of the segments;

wherein each position corresponds to a particular wavelength of light extending from the device; and wherein the second member includes a total of two segments, and wherein said at least one of the first member and the second member is movable among at least four positions to select at least four different wavelengths of light.

2. A device comprising:

a first member; and a second member including segments;

wherein at least one of the first member and the second member is movable among distinct positions as a result of differing voltage states of the segments;

wherein each position corresponds to a particular wavelength of light extending from the device; and wherein the second member includes a total of three segments, and wherein said at least one of the first member and the second member is movable among at least eight positions to select at least eight different wavelengths of light.

3. A device comprising:

a first member; and a second member including segments;

wherein at least one of the first member and the second member is movable among distinct positions as a result of differing voltage states of the segments;

wherein a uniform distance is maintained between the first member and the second member in each of the distinct positions and wherein the uniform distance between the first member and the second member is at least 800 angstroms and no greater than 5000 angstroms.

4. A device comprising:

a first member; and a second member including segments; and a third member, wherein at least one of the first member and the second member is movable among distinct positions as a result of differing voltage states of the segments; and wherein at least one of the first member, the second member, and the third member is movable among a plurality of distinct positions as a result of differing voltage states of the segments.

5. The device of claim 4, wherein the second member is movably positioned between the first member and the third member.

6. The device of claim 5, wherein the second member is a highly reflective plate and one of the first member and the third member is a semi-reflective plate.

7. The device of claim 4, wherein the third member includes a plurality of segments, and wherein the first member is movably positioned between the second and third members.

8. The device of claim 7, wherein the first member is a highly reflective plate and one of the second member and the third member is a semi-reflective plate.

* * * * *